United States Patent [19]

Whitworth

[11] 4,082,152

[45] Apr. 4, 1978

[54] CAM MOUNTING FOR AN IMPACT TOOL

[75] Inventor: Billie J. Whitworth, Pasadena, Tex.

[73] Assignee: Hughes Tool Company, Houston, Tex.

[21] Appl. No.: 759,503

[22] Filed: Jan. 14, 1977

[51] Int. Cl.[2] ..... B25D 9/00

[52] U.S. Cl. ..... 173/119; 173/123

[58] Field of Search ..... 173/119, 120, 123, 139; 74/56

[56] References Cited

U.S. PATENT DOCUMENTS

| | | | |
|---|---|---|---|
| 3,302,732 | 2/1967 | Roll | 173/DIG. 3 |
| 3,322,208 | 5/1967 | Skoog | 173/123 |
| 3,374,685 | 3/1968 | Eheim | 74/56 |
| 3,774,700 | 11/1973 | Shepherd | 173/123 |

*Primary Examiner*—Robert A. Hafer

*Attorney, Agent, or Firm*—Robert A. Felsman

[57] ABSTRACT

A motor driven cam and spring impact tool with an improved mounting for the cam. The impact tool includes a driving shaft for rotation relative to the housing. A hammer is positioned in the housing for axial movement with respect to the housing. An annular cam with cam rollers translates the rotational motion of the hammer. A spring urges the hammer in one direction to cause an impact upon each reciprocation. A collar, driven by the shaft, is connected to the cam for rotating it with respect to the rollers. A pair of pins are connected between the cam and the collar for driving the cam. The holes in the cam receiving the pins are enlarged in the direction of rotation to allow the cam to move a selected distance with respect to the pins. This creates backlash at the drop off points on the camming surface.

3 Claims, 4 Drawing Figures

Fig. 1
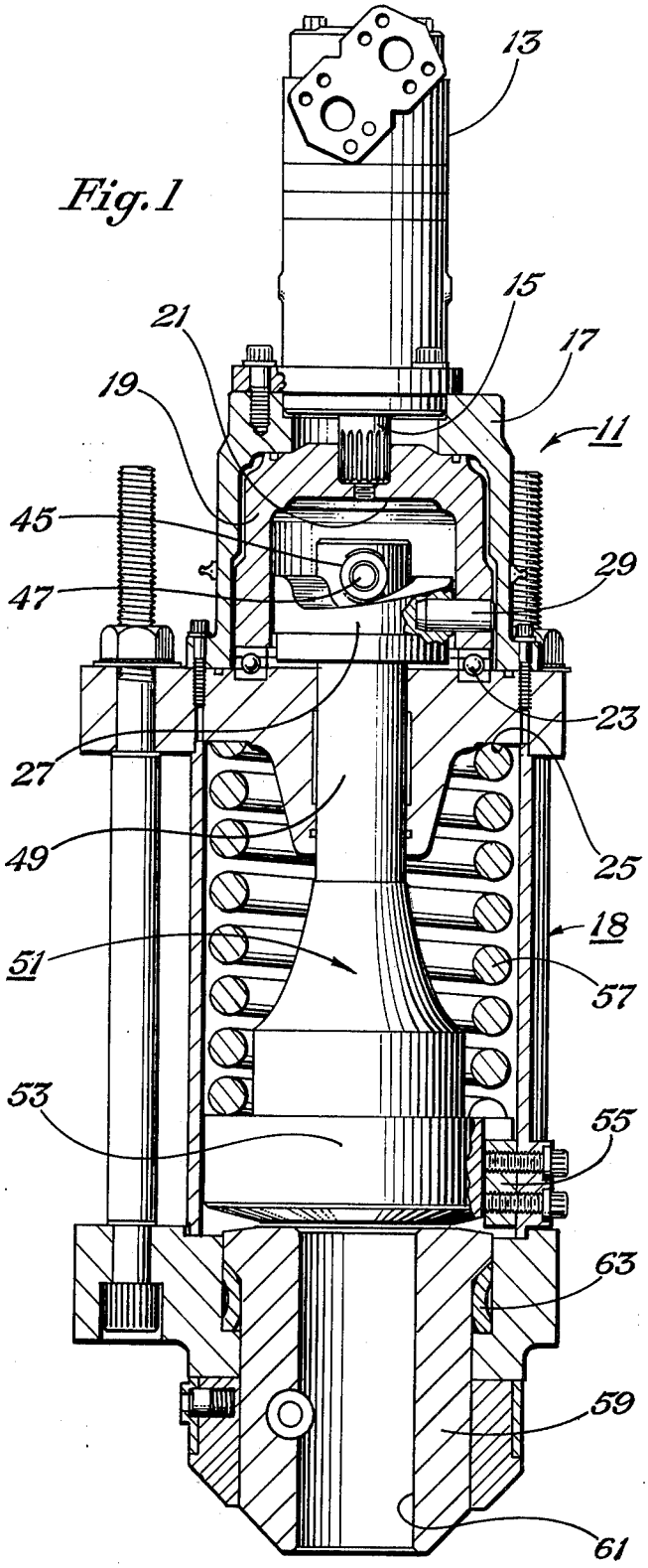
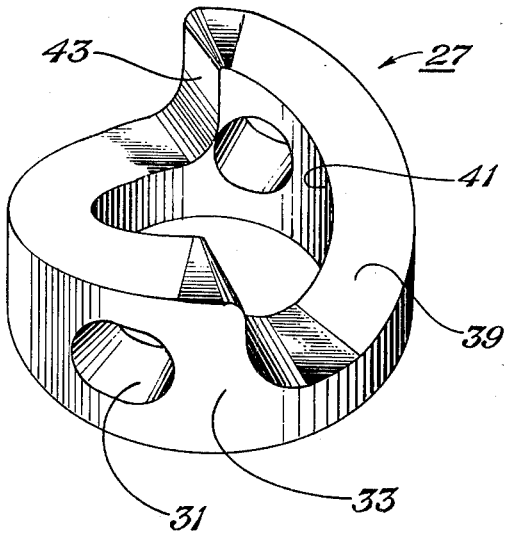
Fig. 2

CAM MOUNTING FOR AN IMPACT TOOL

BACKGROUND OF THE INVENTION

1. Field of the Invention

This invention relates in general to impact tools and in particular to an improved motorized impact tool using a spring and cam to cause reciprocating impacts.

2. Description of the Prior Art

Cam and spring impact tools normally include a driving shaft rotated by a motor, a hammer mounted for reciprocation, and a cam and roller assembly for translating rotational motion to reciprocation. A spring urges the hammer in one direction to create the impact. The cam is annular with a double inclined camming surface. A pair of cam rollers are rotated, the rise and fall causing the reciprocation of the hammer.

Wear occurs at the drop off shoulders because of the large downward force exerted by the spring at the point of maximum compression. In U.S. Pat. No. 3,302,732, the axle on which the rollers are mounted is free to move a short distance with respect to its rotating shaft in the transverse plane. This allows the rollers to move forward at the drop off shoulder, than rearward after dropping off to create backlash, reducing wear. The movement is provided by means of a barrel shaped axle in one embodiment, and flared ends in the passage for the axle in another.

While successful, it is desirable to provide an impact tool with a backlash feature in which the cam is rotated rather than the rollers. Also it is desirable to mount the axle to the shaft solidly, without a barrel shaped axle and flared passages, which are expensive to manufacture.

SUMMARY OF THE INVENTION

It is accordingly a general object to provide an improved motor driven cam and spring impact tool.

It is a further object to provide an improved structure in a cam and spring impact tool that allows backlash between the cam rollers on the cam.

It is a further object to provide an improved structure in a cam and spring impact tool that allows backlash between the cam rollers and the cam, but has the roller axle solidly connected to the shaft.

In accordance with these objects, an improved impact tool is provided wherein the cam is mounted to the rotating means by a pair of transverse pins. The pins are inserted in transverse holes in the cam. These holes are enlarged so as to allow movement between the pins and cam in the transverse plane. This allows the cam to shift forward at the drop off shoulder with respect to the pins and rollers, eliminating interference and reducing wear.

BRIEF DESCRIPTION OF THE DRAWINGS

FIG. 1 is an elevational view, partially in section of an impact tool constructed in accordance with this invention.

FIG. 2 is a perspective view of the annular cam utilized in FIG. 1.

DESCRIPTION OF THE PREFERRED EMBODIMENT

Figure 3:
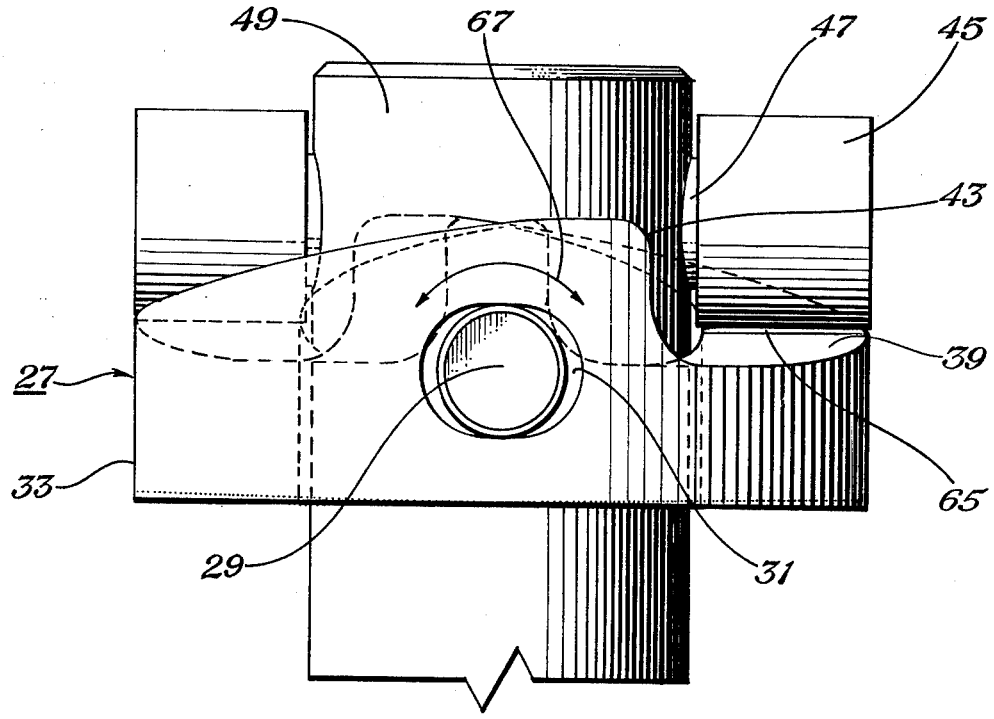
FIG. 3 is an enlarged elevational view of the cam and upper portion of the hammer used in the impact tool of FIG. 1.

An impact tool is shown in FIG. 1, including a hydraulic motor 13 for rotating a splined driving shaft 15 mounted inside bearing carrier 17, which forms a part of housing 18. A transmission means comprising a cylindrical collar 19 has mating splines on its closed end 21 for transmitting the rotational force of the driving shaft 15. The open end or edge of the collar 19 faces in the direction opposite from the driving shaft 15, and is supported on ball bearings 23, which in turn are supported by an internal partition 25 of the housing 18.

Figure 4:
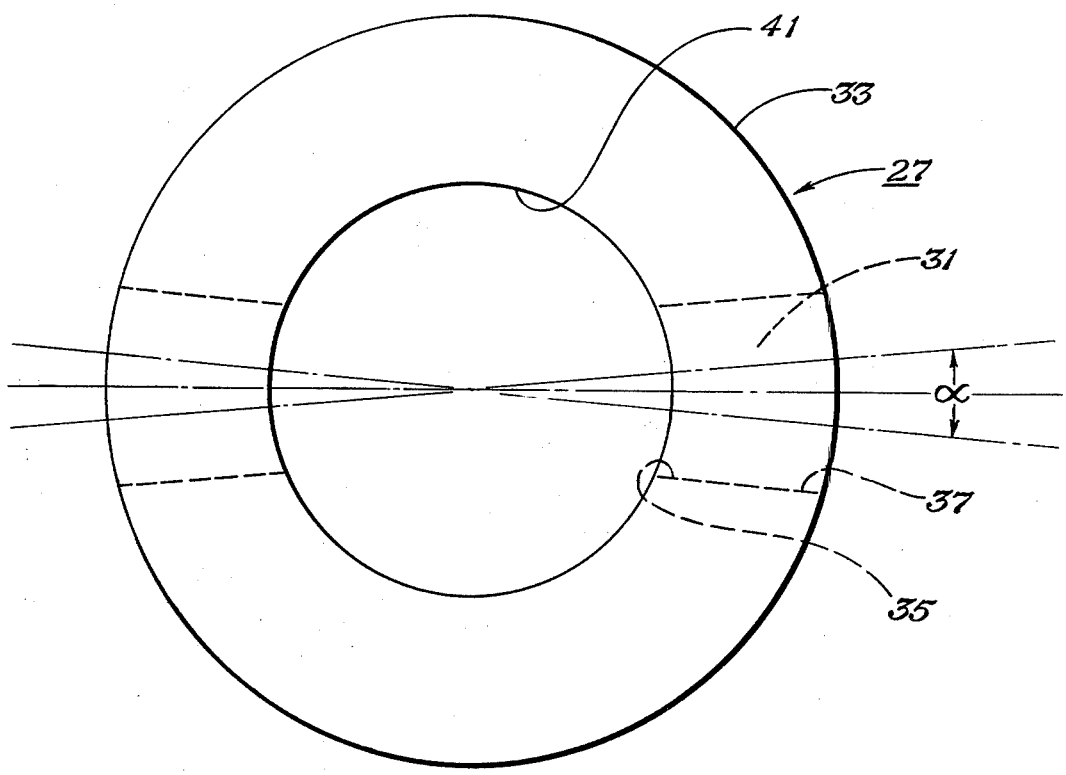
FIG. 4 is a bottom plan view of the annular cam used in the impact tool of FIG. 1.

An annular cam 27, shown also in FIGS. 2–4, is connected to and driven by collar 19. Two cylindrical pins 29 are carried in holes in the sidewall of the collar 19. The pins 29 extend into holes or bores 31 in the sidewall 33 of cam 27. Holes 31 are spaced on opposite sides of cam 27, 180° apart, so that the axes of the pins 29 coincide. The holes provided in the collar 19 for the pins 29 are cylindrical, however holes 31 are wider than the pins 29 in the transverse or rotational direction. This allows the cam to rotate a selected distance $\alpha$ with respect to pins 29 as shown in FIG. 4. Preferably the inner side 35 of hole 31 is approximately cylindrical and is gradually enlarged to the outer side 37 of hole 31 in the plane transverse to the axis of the driving shaft 15. This provides an elongated opening along a circumferential portion of side wall 33. Preferably the enlargement is sufficient to allow a "backlash" angle $\alpha$ of 10°.

Cam 27 has an annular camming surface 39 which faces toward the end 21 of collar 19 and surrounds a center aperature 41. Camming surface 39 has two inclined surfaces, with two drop off shoulders 43. Holes 31 are substantially aligned vertically with the highest or thickest part of the cam, which is just prior to the drop off shoulders 43.

A pair of cam rollers 45 are journaled on a transverse axle 47 and spaced apart so as to roll over cam surface 39. Axle 47 extends through the upper shaft 49 of a hammer or striker 51. Hammer 51 is mounted in housing 18 so as to be capable of axial movement with respect to the housing and driving shaft 15. Hammer 51 is guided at its shaft 49 by the internal shoulder 25 of the housing, and guided at its enlarged striking end 53 by guide 55. The upper end of shaft 49 extends slidingly through the center aperture 41 of the cam, with the axle 47 and rollers 45 disposed between the camming surface 39 and the closed end 21 of collar 19. A coil spring 57 encircles portions of hammer 51, and is pre-compressed to a selected force between internal shoulder 25 of the housing 18 and the enlarged portion 53 of the hammer.

A tool guide 59 is mounted to housing 18 at the base of enlarged portion 53 of the hammer. An axial passage 61 in tool guide 59 receives a working tool (not shown) which contacts the material desired to be broken out. A buffer spring 63 is mounted between tool guide 59 and partition 25, to absorb blows should the working tool not be in solid contact with the work piece.

In operation, the hydraulic motor 13 rotates the drive shaft 15 and collar 19. Cam 27 is thereby rotated by pins 29, which transmit the rotation force. Camming surface 39 engages the cam rollers 45, as shown in FIG. 3, to cause the hammer 51 to move axially toward the driving shaft 15, further compressing coil spring 57. As the cam rotates the drop off points 43 past the cam rollers 45, the cam rollers 45 are pulled by the spring toward the lowest portion of the camming surface 39. The force of the spring causes the working tool to strike the work piece with a large force. Should the working tool be fully extended or break through the work piece, enlarged portion 53 of the hammer strikes tool guide 59.

As the cam 27 is rotated clockwise as seen from the top, the pins 29 will be driving against holes 31 on the forward side. At the moment when the cam rollers 45 are at the drop off shoulders 43, a component of the force of spring 57 causes cam 27 to shift forward with respect to pins 29 a circumferential distance equivalent to the angle $\alpha$. This backlash allows the cam rollers 45 to drop more easily, with less force exerted on the shoulder at the drop-off points 43, reducing wear. Once the cam rollers begin climbing the inclined surface, pins 29 move forward or clockwise with respect to cam 27 a circumferential distance to the angle $\alpha$.

The cam rollers 45 do not contact the camming surface 39 after dropping off until the cam drop off shoulders 43 have been rotated past the cam rollers 45 approximately 30°. Once the cam rollers begin contacting the inclined surface again, should one roller contact the camming surface prior to the other, as shown by the gap indicated as numerals 65 in FIG. 4, then the cam is free to tip about the axes of the pins 29, as indicated by arrows 67 and phantom lines. This equalizes the load imposed by the cam rollers on the cam.

It should be apparent that an invention having significant improvements has been provided. The cam shifts with respect to the cam rollers, minimizing interference. By allowing the cam to backlash, rather than the cam rollers themselves, the cam rollers can be mounted immovably with the hammer. This avoids the need for a barrel shaped axle or flared passage.

While the invention has been shown in only one of its forms, it should be apparent to those skilled in the art that it is not so limited but is susceptible to various changes and modifications without departing from the spirit thereof.

I claim:

1. In a motor driven impact tool having a housing, a driving shaft mounted in the housing for rotation relative to the housing, a hammer positioned in the housing for axial movement with respect to the driving shaft, an annular cam with an inclined camming surface, a pair of cooperating cam rollers to translate rotary motion of the driving shaft to reciprocal motion of the hammer, and a spring urging the hammer in one direction to provide an impact, an improved cam mounting comprising:

a cylindrical collar, having its closed end connected to the driving shaft, its walls encircling the cam and connected to the cam by a pair of pins inserted in apertures formed in the cam transverse to the axis of the driving shaft and spaced apart substantially 180°;

an axle mounted transverse to one end of the hammer and immovable with respect to the hammer, the cam rollers being mounted on each end of the axle and in contact with the camming surface for causing the hammer to reciprocate as the cam is rotated ;

the apertures in the cam which the pins are inserted being circumferentially elongated so as to allow the cam to move a selected distance with respect to the pins in a plane substantially normal to the axis of the driving shaft for creating backlash.

2. The apparatus according to claim 1 wherein the cam is free to move 10° with respect to the pins.

3. In a motor driven impact tool having a housing, a driving shaft mounted in the housing for rotation relative to the housing, a hammer positioned in the housing for axial movement, an annular cam with an inclined camming surface, a cooperating cam roller to translate rotary motion of the driving shaft to reciprocal motion of the hammer, and spring means urging the hammer in one direction to provide an impact, an improved cam mounting comprising:

transmission means, connected between the driving shaft and the cam, for rotating the cam with respect to the housing, the connection between the transmission means and the cam being a plurality of pins, each pin having one end inserted in a first hole formed in the cam and the other end inserted in a second hole formed in the transmission means;

an axle mounted transversely and immovably to the hammer, the cam roller being mounted on the axle and in contact with the camming surface for causing the hammer to reciprocate as the cam is rotated;

one of the holes for each pin being elongated so as to allow the cam to shift with respect to its transmission means in the direction of rotation.

* * * * *